US007874554B2

(12) United States Patent
Dopfer et al.

(10) Patent No.: US 7,874,554 B2
(45) Date of Patent: Jan. 25, 2011

(54) CONTINUOUS SEPARATION OF LOOSE SHEETS

(75) Inventors: Peter Dopfer, Geltendorf (DE); Christian Casensky, Dachau (DE); Erwin Demmeler, Memmingen (DE); Mario Mönch, Unterhaching (DE)

(73) Assignee: Giesecke & Devrient GmbH, Munich (DE)

( * ) Notice: Subject to any disclaimer, the term of this patent is extended or adjusted under 35 U.S.C. 154(b) by 371 days.

(21) Appl. No.: 10/563,246

(22) PCT Filed: Jul. 2, 2004

(86) PCT No.: PCT/EP2004/007245

§ 371 (c)(1),
(2), (4) Date: May 3, 2006

(87) PCT Pub. No.: WO2005/003005

PCT Pub. Date: Jan. 13, 2005

(65) Prior Publication Data

US 2007/0023989 A1 Feb. 1, 2007

(30) Foreign Application Priority Data

Jul. 3, 2003 (DE) ..... 103 30 107

(51) Int. Cl.
*B65H 5/22* (2006.01)

(52) U.S. Cl. ..... 271/3.04; 271/212; 271/218; 271/157; 414/795.8; 414/793.4

(58) Field of Classification Search ..... 271/157–159, 271/3.04, 212, 218; 414/795.8, 790.8, 790, 414/791.1, 791, 789.8, 792.8, 793.4–794.3
See application file for complete search history.

(56) References Cited

U.S. PATENT DOCUMENTS 5,011,126 A 4/1991 Yasuhiro et al.

(Continued)

FOREIGN PATENT DOCUMENTS

DE 44 24 287 A1 1/1996

(Continued)

OTHER PUBLICATIONS

"CPS 2400 Autofeeder, Field Service Training Manual, Version 1.0", Currency Systems International Inc., Jun. 30, 2000, serial No. 440-0111-001 Rev. A - (cited in Opposition filed Jun. 29, 2010 in the European Patent Office).

(Continued)

*Primary Examiner*—Stefanos Karmis
*Assistant Examiner*—Jeremy Severson
(74) *Attorney, Agent, or Firm*—Bacon & Thomas, PLLC

(57) ABSTRACT

The present invention relates to a method for automated, continuous singling of loose sheet material, by the steps of feeding a stack of loose sheet material to be singled located on a first feeding element from a deposit position to a position in which the uppermost sheet of the stack can be grasped by the singling unit, sheet-by-sheet singling of the fed stack by the singling unit, the stack being fed by the feeding element such that the particular uppermost sheet of the stack can be grasped by the singling unit, feeding a further stack of loose sheet material to be fed located on a second feeding element from the deposit position to a position in which the uppermost sheet of the stack to be fed is located below the first feeding element, and uniting the stack to be singled and the fed stack by drawing the first feeding element out of the feeding path.

23 Claims, 5 Drawing Sheets

U.S. PATENT DOCUMENTS

| | | | | |
|---|---|---|---|---|
| 5,242,261 | A * | 9/1993 | Pollich et al. | 414/795.8 |
| 5,538,238 | A * | 7/1996 | Filsinger | 271/159 |
| 5,803,446 | A * | 9/1998 | Leuthold et al. | 271/9.08 |
| 5,871,209 | A | 2/1999 | Orchard et al. | |
| 6,000,691 | A | 12/1999 | Chmelar | |
| 6,334,610 | B1 * | 1/2002 | Minamishin et al. | 271/3.04 |
| 6,652,218 | B1 * | 11/2003 | Eggebrecht et al. | 414/798.9 |
| 2004/0262834 | A1 * | 12/2004 | Bantlin et al. | 271/157 |

FOREIGN PATENT DOCUMENTS

| | | | |
|---|---|---|---|
| DE | 195 12 505 | A1 | 10/1996 |
| DE | 195 16 582 | A1 | 11/1996 |
| DE | 103 30 107.0 | | 7/2003 |
| EP | 0 535 361 | A2 | 4/1993 |
| EP | 533 361 | A2 | 4/1993 |
| JP | 9-104539 | A | 4/1997 |
| WO | 96/32349 | A1 | 10/1996 |
| WO | 2004/007245 | | 7/2004 |

OTHER PUBLICATIONS

Order letter from JEZ to CSI, Mar. 16, 1999 (redacted to remove price information) - (cited in Opposition filed Jun. 29, 2010 in the European Patent Office).

Invoices from CSI to JEZ in respect of the order (redacted to remove price information) - (cited in Opposition filed Jun. 29, 2010 in the European Patent Office).

"Agenda for the Factory Acceptance Test with Johan Enschede en Zonen, Sep. 27 - Oct. 1, 1999", Currency Systems International Inc., Sep. 16, 1999 - (cited in Opposition filed Jun. 29, 2010 in the European Patent Office).

Factory Acceptance Test documentation, Oct. 1, 1999 - (cited in Opposition filed Jun. 29, 2010 in the European Patent Office).

Declaration of James W. Griffin, Jun. 22, 2010 - (cited in Opposition filed Jun. 29, 2010 in the European Patent Office).

Declaration of Dick Lubbers, Jun. 29, 2010 - (cited in Opposition filed Jun. 29, 2010 in the European Patent Office).

Declaration of Elmar Hooijer, Jun. 28, 2010 - (cited in Opposition filed Jun. 29, 2010 in the European Patent Office).

Declaration of Gerrit van de Kiok, Jun. 29, 2010 - (cited in Opposition filed Jun. 29, 2010 in the European Patent Office).

"CPS 2400 Autofeeder Operator User Guide, Version 1.0", Currency Systems International Inc., Sep. 30, 1999, serial No. 440-0101-001 Rev. A - (cited in Opposition filed Jun. 29, 2010 in the European Patent Office).

* cited by examiner

FIG.3a
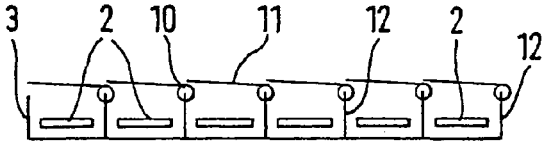
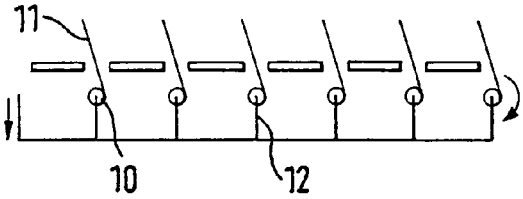
FIG.3b
FIG.4a
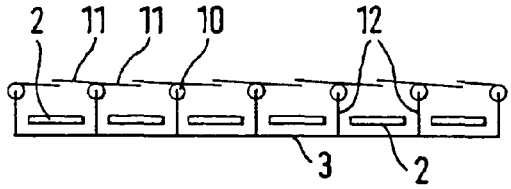
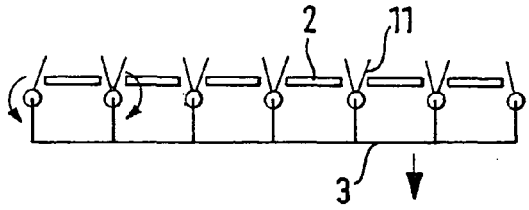
FIG.4b
FIG.5a
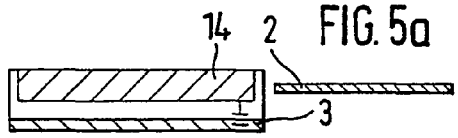
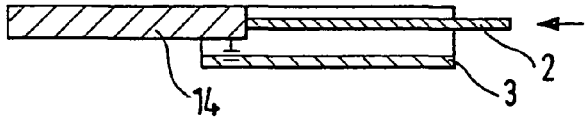
FIG.5b
FIG.7
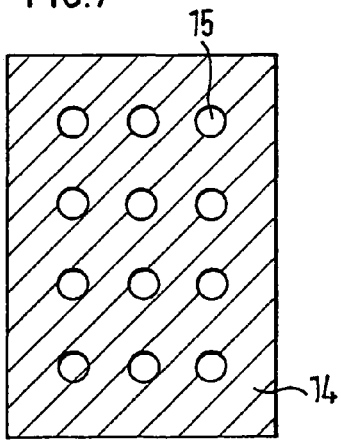
FIG.6a
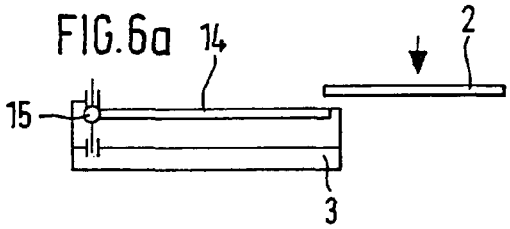
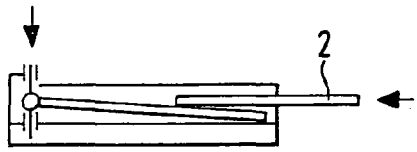
FIG.6b

CONTINUOUS SEPARATION OF LOOSE SHEETS

FIELD OF THE INVENTION

This invention relates to the automatic, continuous singling of stacks of loose sheet material. It relates in particular to a singling method, a singling apparatus and the use of the singling apparatus.

Such methods and apparatuses are used in particular for singling bank-note stacks to check them singly for authenticity and/or fitness in a fully automatic process.

BACKGROUND OF THE INVENTION

There exists a general problem of being able to obtain uninterrupted operation and maximum throughput in a singling station to which sheet material to be singled is fed in the form of bundles that possibly arrive irregularly. It is obviously rather unsuitable to use for this purpose transport systems that transport a stack to be singled to the singling unit only when the latter has finished singling a current stack. Such solutions can be realized economically due to the simple coordination of the bundle logistics, but in practice they have a considerably limited throughput which is restricted by the feed time of the next stack to be singled to the singling unit. Developments of this principle reduce interruption times by faster feed of further stacks, but they likewise settle for suboptimal throughput rates dependent on the feed speed, and cause additional downtimes due to the increased transport speed—possibly due to displacements of stacks—which results in increased maintenance effort.

DE 195 12 505 A1 from the applicant describes a method for continuous singling of stacks of sheets which avoids the stated disadvantages of fixed-cycle solutions. During singling of a stack of loose sheet material, a further stack is fed in such a way that it can be grasped and singled without interruption by the singling unit after processing of the first stack. Since singling now does not have to be interrupted for providing the next stack, uninterrupted operation is possible.

Continuous feed of stacks of sheets to the singling unit is ensured by the interaction of two rake-shaped feeding elements which alternately take over a stack from a likewise rake-shaped deposit area and transport it from a deposit position on a feeding path to a singling position where it can be singled by the singling unit. After a stack has been singled sheet by sheet by the singling unit, the corresponding feeding element must be returned from the singling position to the deposit position for receiving a further stack already waiting on the deposit area. Since the other feeding element is already located in the singling position at this time to ensure continuous singling, the first feeding element cannot be returned on the feeding path, but must be returned on a parallel path outside the feeding path. For this purpose, the rake-shaped feeding element is drawn out of the feeding path and guided parallel thereto to a position adjacent the rake-shaped deposit area. Since the prongs of the feeding element interact with the prongs of the deposit area in such a way that the feeding element can be inserted into the deposit area laterally from the adjacent position, the feeding element to be returned is finally inserted into the deposit position where, by a new motion on the feeding path, it takes over the stack lying ready on the deposit area and feeds it to the singling unit.

The transport system of DE 195 12 505 A1 thus requires substantially three elements, the immovable deposit area and two similar, vertically and horizontally movable feeding elements which alternate permanently between the deposit position and the singling position through an uninterrupted loop motion. The disadvantage to be mentioned for this concept is the complex constructional principle which, for checking the multiaxial motion of each feeding element in agreement with the position of the other feeding element, requires the use of a multiplicity of position sensors and a control electronics which coordinates the loop motions of the feeding elements. The complex construction increases production costs and leads to increased maintenance effort and therefore to increased operating costs and possibly downtimes. Moreover, in the case of faster singling units or small stack sizes, supply problems are conceivable since, for maintaining continuous singling, the long motion paths of the feeding elements must be covered in a shorter time than the singling unit requires for singling a stack.

Starting out from DE 195 12 505 A1, the invention is based on the problem of proposing a method for continuous singling of sheet material which is based on a simple constructional principle and which allows fast feeding of stacks to be singled.

SUMMARY OF THE INVENTION

This problem is solved by the subject matter of the independent claims. The dependent claims describe preferred embodiments.

According to the invention, a multiaxially movable first feeding element and a uniaxially movable second feeding element are used as the feeding device to ensure continuous singling by a singling unit.

Preferably, the feeding elements are used in such a way that the first feeding element receives a first stack of loose sheet material to be singled in the deposit position and guides it through a uniaxial motion on the feeding path to a position in which the uppermost sheet of the stack can be grasped by the singling unit. At the same time it continuously feeds the stack growing smaller in the course of sheet-by-sheet singling, so that the particular uppermost sheet of the stack can be grasped and singled by the singling unit. The second, only uniaxially movable feeding element is meanwhile located in the deposit position and, during singling of the first stack, receives a further stack to be fed and likewise to be singled, and guides it on the feeding path from the deposit position to a position in which the uppermost sheet of the stack comes to lie directly below the first feeding element. The first stack to be singled and the subsequently fed second stack are thereupon united, by the first feeding element now positioned between the two stacks being drawn out of the feeding path. The first feeding element is then inserted into the feeding path at the position of the second feeding element on a loop path, and thus takes over the united stack from the second feeding element. The second feeding element can now return to the deposit position through a new uniaxial motion on the feeding path to receive the next stack to be singled.

The invention offers the advantage of a considerably simpler construction, since it can ensure continuous singling of stacks of loose sheet material by the use of only two elements, namely by a multiaxially moveable first feeding element and a uniaxially movable second feeding element. The simplification consists primarily in that only one feeding element executing an elaborately controlled, multiaxial loop motion is now needed, while the other feeding element executes a simple uniaxial motion on the feeding path. As compared to the prior art, the simpler control and mechanics of such a construction leads to higher reliability through increased failure safety and also to higher productivity and throughput due to less frequent malfunctions. A further important advantage is the maintenance of continuous singling in particular in the case of very fast singling units or small stacks, since the multiaxially movable first feeding element describes only a short and quickly traversed motion path when taking over the united stack. Therefore, the uniaxially movable second feeding element can feed further stacks out of the deposit position faster than comparable feeding elements with more complex motion paths. The invention can thus increase the throughput and reliability of a singling unit while involving a simpler construction.

The multiaxial motion path of the first feeding element can be traveled in different ways. One embodiment consists for example in executing exclusively motions perpendicular and parallel to the feeding path. The feeding element is drawn out of the feeding path perpendicularly when the stacks are united, then brought to a position adjacent the second feeding element by a motion parallel to the feeding path, and finally brought to the position of the second feeding element by a motion perpendicular to the feeding path when taking over the united stack. Further motion paths are also conceivable, for example an ellipsoidal path.

Inserting the first feeding element from outside the feeding path to the place of the second feeding element in the feeding path can be effected in different ways. It is thus possible in one embodiment to equip the deposit surface of the first feeding element with an outwardly tapered edge with which it is inserted into the feeding path between the upper side of the second feeding element and the lowermost sheet of the united stack to take over the united stack.

According to a particularly advantageous embodiment of the invention, the feeding elements are realized as rake-shaped grippers in such a way that their prongs fit into each other when the two feeding elements are located at the same position in the feeding path upon take-over of the united stack by the first feeding element. In this situation, immediately after insertion of the first feeding element into the feeding path, the united stack is carried by both interlocking feeding elements at the same time before the second feeding element moves back to the deposit position to receive a further stack. The decisive advantage of this rake-shaped embodiment of the feeding elements is the possibility of simple take-over of the united stack by the first feeding element. Instead of exact insertion of the first feeding element into the second feeding element, it is also possible to insert the first feeding element into the feeding path below the second feeding element and then slide it through the second feeding element for taking over the united stack. In other words, the second feeding element will preferably have depressions and the first feeding element be formed complementarily so that it can engage the depressions at least partly.

Another advantageous embodiment provides a second feeding element as a deposit area with numerous parallel straight depressions, which are recognizable as lateral openings in the second feeding element when a further stack is fed. Upon take-over of the united stack by the rake-shaped first feeding element, the prongs thereof can move laterally into the depressions of the second feeding element and take over the stack by returning the second feeding element to the deposit position.

It is likewise possible to realize the drawing of the first feeding element out of the feeding path and the insertion thereof into the feeding path advantageously by a rotatable assembly of the feeding element. The first feeding element thus unites the two stacks by a swivel motion out of the feeding path around a rotation axis parallel to the feeding path, thereupon moving to a position adjacent the second feeding element, and finally taking over the united stack by a swivel motion into the feeding path around the same rotation axis. The advantage of this variant is that it is simple to realize mechanically.

For optimizing stack logistics and the coordination of the feeding elements, it is expedient to provide various sensors. It is thus advantageous to use a sensor that recognizes the presence of a further stack to be singled fed by the second feeding element, directly below the first feeding element. Via an electromechanical control it is thus possible to initiate the uniting of the two stacks and the take-over of the united stack by the first feeding element in good time. It is likewise advantageous to provide sensors for recognizing the last sheet of a stack to be singled, so that the feeding elements can then be returned to the initial position. Furthermore, sensors can be used advantageously for recognizing a stack to be singled located in the deposit position, in order to initiate the feed thereof by the second feeding element and the take-over of the stack to be united by the first feeding element.

Further, it can be provided that the second feeding element has a deposit surface with holes and a plurality of opposing elements which can reach through the holes. The deposit surface and the opposing elements can be adapted to be shifted relative to each other to be able to hold a stack of sheet material to be singled spaced from the deposit surface. Moreover, the opposing elements can preferably engage the holes of the second feeding element to such an extent as to provide a substantially closed deposit surface for subsequent application of a loose stack of sheet material to be singled.

BRIEF DESCRIPTION OF THE DRAWINGS

Further advantages and features of the invention will be made clearer in the following description of the structure and operation of an embodiment of the invention.

FIGS. 3*a, b* show the operation of yet another embodiment in two different operating states in a view from the front;

FIGS. 4*a, b* show the operation of yet another embodiment in two different operating states in a view from the front;

FIGS. 5*a, b* show the operation of yet another embodiment in two different operating states in a view from the side;

FIGS. 6*a, b* show the operation of yet another embodiment in two different operating states in a view from the side;

FIG. 7 shows a view from above of a feeding element of the embodiment according to FIGS. 8*a-g;*

DETAILED DESCRIPTION OF THE EMBODIMENTS

Figure 1:
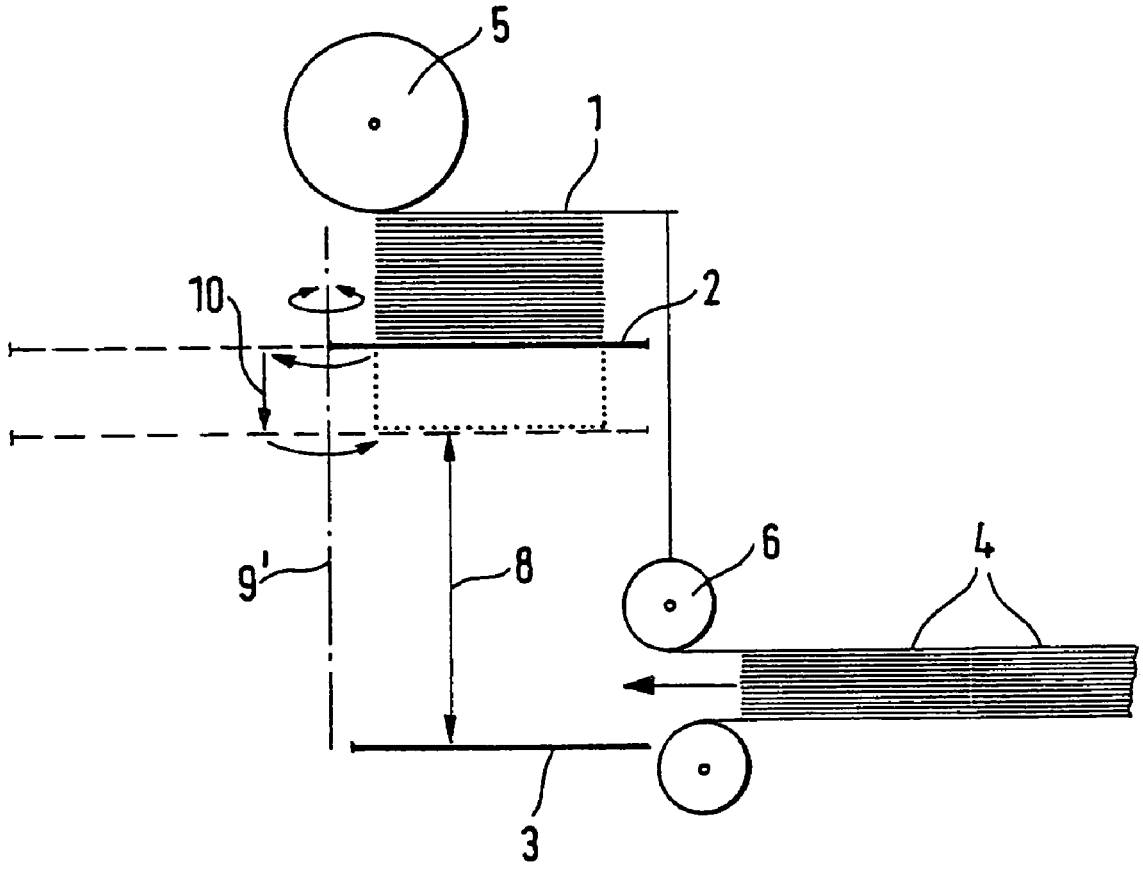
FIG. 1 shows the schematic structure of a preferred embodiment of the invention.

FIG. 1 shows the schematic structure of an inventive singler. It comprises a multiaxially movable first feeding element 2 which carries a stack 1 of loose bank notes to be singled and feeds it to the singling unit 5 in such a way that the first bank note of the stack 1 can be grasped and singled by the singling roller of the singling unit 5. A uniaxially movable second feeding element 3 is located in a lower deposit position and receives from the stack inserting device 6 a further bank-note stack 4 to be fed to the singling unit 5. The second feeding element 3 executes exclusively uniaxial motions on the feeding path 8 by moving the bank-note stacks 4 to be fed from the deposit position to the position shown by dotted lines directly below the first feeding element 2 and returning to the deposit position after the take-over thereof by the first feeding element 2. During singling, the first feeding element 2 feeds the stack 1 to be singled through a uniaxial motion on the feeding path 8 in such a way that the particular uppermost bank note can be grasped by the singling unit 5. As soon as the second feeding element 3 has fed a further stack to be singled—indicated by dotted lines—the first feeding element 2 performs a loop motion 10 to unite the fed stack with the stack 1 to be singled and then take over the united stack from the second feeding element 3. This is done by the first feeding element 2 replacing the second feeding element 3, following the loop path 10, at the position thereof in the feeding path 8. The positions that the first feeding element 2 assumes on its loop path 10 are shown in each case by dashed lines in FIG. 1. The loop motion 10 starts with the first feeding element 2 executing a lateral rotation around a rotation axis 9 parallel to the feeding path 8 and thereby moving out of the feeding path perpendicularly and thus uniting the bank-note stack 1 to be singled and the fed stack indicated by dotted lines. By a downward motion parallel to and outside the feeding path, and by a reverse rotation of the first feeding element 2 around the rotation axis 9 into the feeding path 8, the loop motion 10 thereof is completed and the first feeding element 2 is located at its new position between bank-note stack 1 and the second feeding element 3. The second feeding element 3 can then be moved back to the lower position shown in FIG. 1 to receive the next stack 4.

FIG. 2 illustrates the inventive principle of stack feed for ensuring continuous singling of bank-note stacks according to a further embodiment. FIG. 2*a* shows a front view of a bank-note stack 1 which, held and fed by the rake-shaped first feeding element 2, is singled by the singling roller of the singling unit 5. Meanwhile the second feeding element 3, which is equipped with a multiplicity of parallel, straight depressions for receiving the prongs of the rake-shaped first feeding element 2, is located in the deposit position. There it receives a bank-note stack 4 to be fed that is transported by the stack inserting device 6 to the deposit position (FIG. 2*b*). The fed bank-note stacks 1, 4 can for example be previously debanded automatically. The second feeding element 3 feeds the stack 4 to be fed for singling by moving on the feeding path 8 in the direction of the singling unit 5 until the bank-note stack 4 to be fed comes to lie directly below the first feeding element 2 (FIG. 2*c*). The first feeding element 2 is now located between the stack 1 to be singled and the fed stack 4.

Figure 2C:
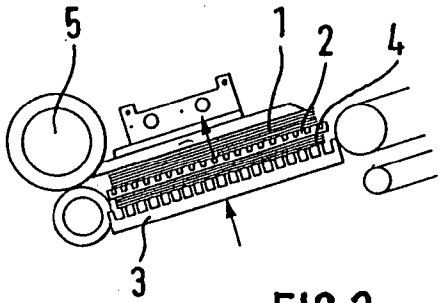
FIGS. 2*a-f* show the operation of a further embodiment in several different operating states, whereby FIGS. 2*a, b, c, e, f* are views from the front and FIG. 2*d* a view from the side.
Figure 2B:
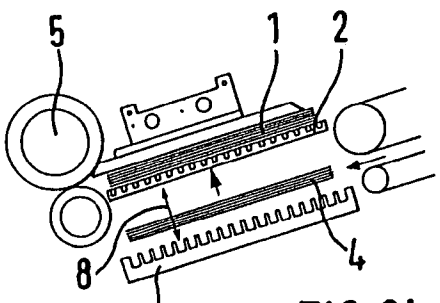
Figure 2A:
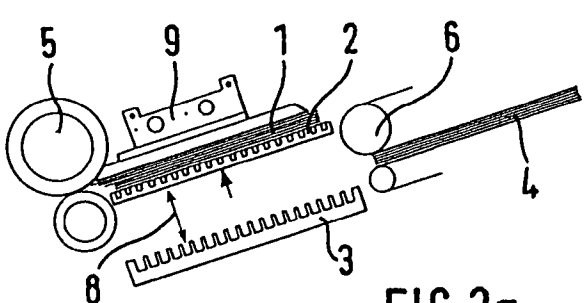
Figure 2F:
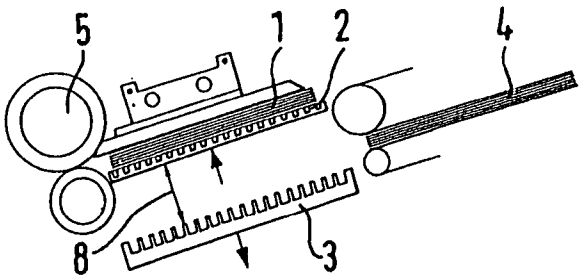
Figure 2E:
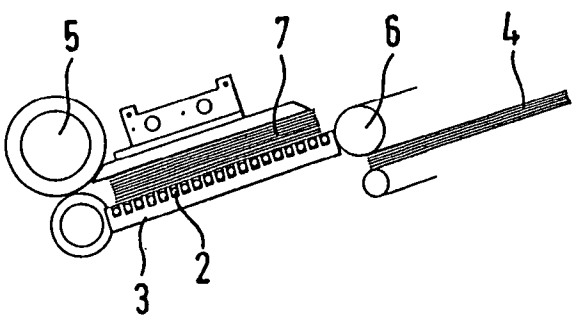
Figure 2D:
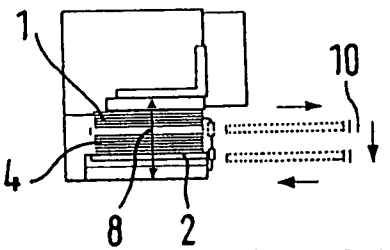

FIG. 2*d* shows a side view, rotated by 90° in comparison with FIGS. 2*a, b, c, e, f*, of the uniting of the stacks by the re-engagement of the rake-shaped first feeding element 2 along the loop path 10. Said element is drawn out of its position parallel to its prongs rearward out of the feeding path 8 to the position shown by dashed lines, thereby causing the stack 1 to be singled located above the first feeding element 2 to be united with the bank-note stack 4 to be fed located below the first feeding element 2. Then the first feeding element 2 is guided parallel to the feeding path 8 to the level of the second feeding element 3 (as shown by dashed lines) and inserted into the feeding path 8 again by a forward motion at the position of the second feeding element 3. At the same time the prongs of the rake-shaped first feeding element 2 slide into the depressions of the second feeding element 3.

FIG. 2*e* shows in the side view that both feeding elements carry the united bank-note stack 7 equally in this situation. At the same time the next stack to be fed 4 is already being brought up by the stack inserting device 6. By returning the now free second feeding element 3 to the deposit position by a uniaxial motion along the feeding path 8, the initial situation of FIG. 2*a* is restored. The second feeding element 3 is now ready to receive a further bank-note stack 4 to be fed (FIG. 2*f*) and the process starts again.

It should be noted that, according to a further idea of the present invention, the singler can be designed so that bank notes to be singled can alternatively be fed automatically, e.g. by the stack inserting device 6, or be inserted manually, by e.g. an operator placing a loose stack of bank notes on the second feeding element 3 in the systems according to FIG. 2*a*. While automatic feed is thus effected e.g. from the side, the manual input can be effected from the front. It can likewise be provided that there are different feeding routes for automatically feeding bank notes. Thus, alongside the stack inserting device 6 for laterally feeding bank-note bundles automatically de-banded in the feeding route, there can also be an additional feed for automatically feeding bank-note bundles already inputted in loose form.

In particular in case of poor bank note quality, a problem of the second feeding element 3 may be that the lowermost bank notes of the stack 4 fed by the stack inserting device 6 jam in the depressions of the feeding element 3. To prevent this, a substantially closed and contiguous deposit surface of the second feeding element 3 will preferably be realized.

As displayed in FIG. 3, which shows a view from the front e.g. according to FIG. 2*e*, the second feeding element 3 can have for example a slatted structure having e.g. surface elements 11 which are each rotatably mounted around an associated axle 13 and connected with a bar 12 of the feeding element 3. As illustrated in FIG. 3*a*, said rotatable surface elements 11 can slightly overlap so as to form a deposit surface to facilitate the sliding on of the fed stack 4.

When, in an operating state according to FIG. 2*f*, the second feeding element 3 is moved downward again to be able to receive a new stack, the rotatable surface elements 11 are rotated around their rotation axle 10 into an open position, as illustrated in FIG. 3*b*, being actively controlled or passively induced merely by the downward sliding of the feeding element 3. This permits the second feeding element 3 to slide downward past the rake-shaped first feeding element 2. The folding back of the surface elements 11 into the overlapping arrangement according to FIG. 3*a* can again be effected by active control or passively.

FIG. 4 shows a further embodiment which differs from that of FIG. 3 in that the slats, i.e. the surface elements 11, are of bipartite construction.

According to yet another embodiment according to FIG. 5, which shows a view from the side e.g. according to FIG. 2*d*, the second feeding element 3 has a deposit surface 14 which can be pushed out forward by meshing of the rake 2 with the depressions of the feeding element 3 (see FIG. 5*b*), and is moved back to the previous position when the rake 2 is moved out (see FIG. 5*a*). The deposit surface 14 for fed bank-note stacks 4 is at the same time connected to the other components of the feeding element 3 e.g. by means of a longitudinal guide. The shifting of the deposit surface 14 can, as in the other cases, again be effected either actively controlled by a motor or passively e.g. by means of a spring bias.

In comparison with FIG. 5, the deposit surface 14 can further, according to FIG. 6, also be mounted to be rotatable around an axle 15 and preferably also displaceable vertically. By meshing of the rake 2 with the depressions of the feeding element 3 the deposit surface 14 is then both rotated and pushed downward (see FIG. 6*b*).

To realize a substantially closed and contiguous deposit surface of the second feeding element 3, said element can further also be realized in the way shown in FIGS. 7 and 8. In this case, the second feeding element 3 likewise has a largely flat deposit surface 14. The deposit surface 14 has a plurality of holes 15 distributed over the surface through which complementarily disposed bars 17 present on a base plate 18 can reach. The individual parallel prongs of the rake-shaped first feeding element 2 can engage between the bars 17.

Figure 8C:
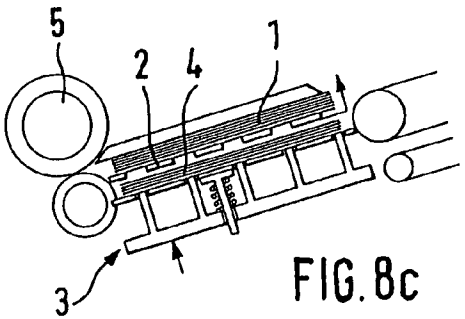
FIGS. 8*a-g* show the operation of a further embodiment in several different operating states, whereby FIGS. 8*a, b, c, f, g* are views from the front and FIGS. 8*d* and *e* views from the side.
Figure 8B:
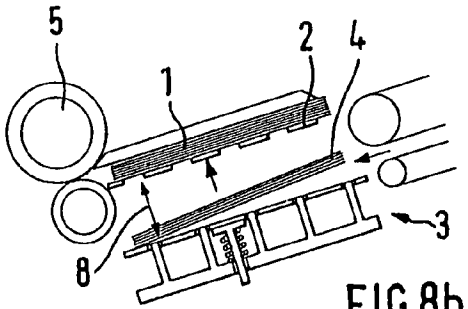
Figure 8A:
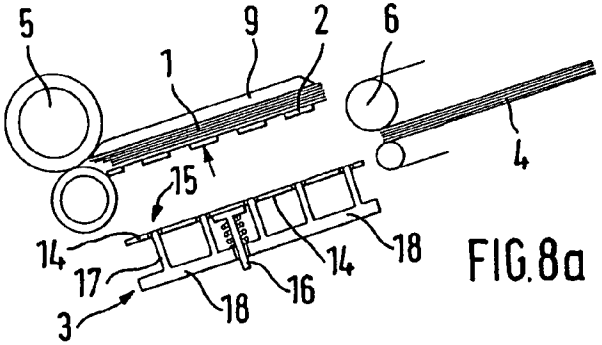
Figure 8G:
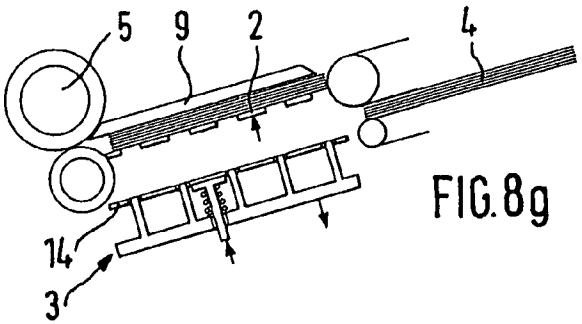
Figure 8F:
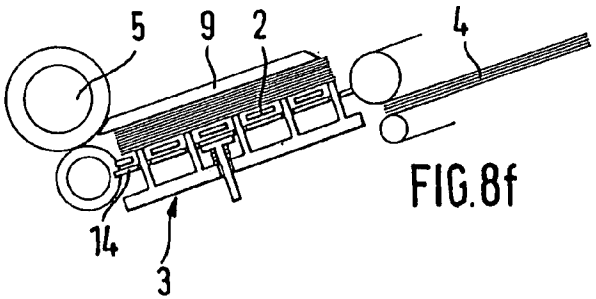

FIGS. 8*a* to 8*g* show different operating states of an associated singler. In a first phase (FIG. 8*a*), the rake-shaped first feeding element 2 feeds bank notes of the stack 1 mounted thereabove in the direction of an air baffle plate 9 of the singler according to the singling speed. The second feeding element 3 as the lower bank note deposit area is in a standby position and ready to insert the next bank-note stack 4. The bars 17 are either down in a retracted position in comparison with the deposit surface 14, or alternatively, as shown in FIG. 8*a*, are shifted actively against a spring 16 to engage the holes 15 preferably to such an extent that the deposit surface 14 forms a largely flat and closed bank note deposit area with the moved-in bars 17.

In a second phase (FIG. 8*b*), bundle insertion is effected. The singling process meanwhile continues and the rake 2 is still moving in the direction of the air baffle plate 9. It should be emphasized that other types of singling units without air baffle plates can of course also be used.

Then the deposit surface 14 moves in the direction of the rake 2 until e.g. a sensor mounted on the underside of the rake recognizes that the underside of the rake is being touched by the uppermost bank note of the stack 4 resting on the deposit surface 14 (FIG. 8*c*). The motions of rake 2 and deposit surface 14 are synchronized from then on, i.e. displacement is effected upward against the air baffle plate 9 at the same speed.

Figure 8D:
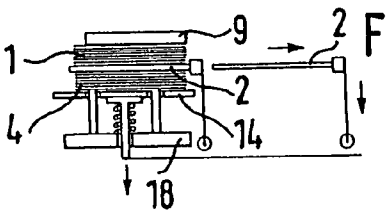
Figure 8E:
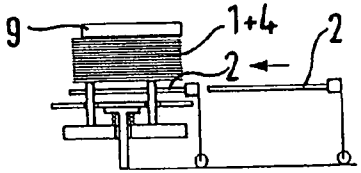

The rake 2 is then drawn back from the stack area, thereby causing the bank notes located on and under the rake 2 to be united into a total stack. The rake 2 then moves downward (FIG. 8*d*). During the downward motion of the rake 2 the latter takes along the deposit surface 14 downward via a mechanical coupling. The BN stack 1, 4 thus only rests on the bars 17 which are guided through the holes 15 of the deposit surface. Thus, the space below the stack 1, 4 becomes free for meshing of the rake 2 between the bars 17, and the rake 2 is then moved between the bars 17 (FIGS. 8*e, f*). Then the rake 2 again takes over the feed of the bank-note stack 1, 4 united by drawing out the rake 2.

Then the deposit surface 14 moves to the standby position again by downward motion. At the same time, deposit surface 14 and bars 17 are shifted relative to each other to such an extent that the bars 17 and the deposit surface 14 again form a flat, closed surface which permits trouble-free lateral insertion of the next bank-note stack 4. The rake 2 meanwhile further feeds the (upper) bank-note stack 1. This assembly thus likewise permits continuous singling of bank notes in a particularly reliable way.

Figure 9:
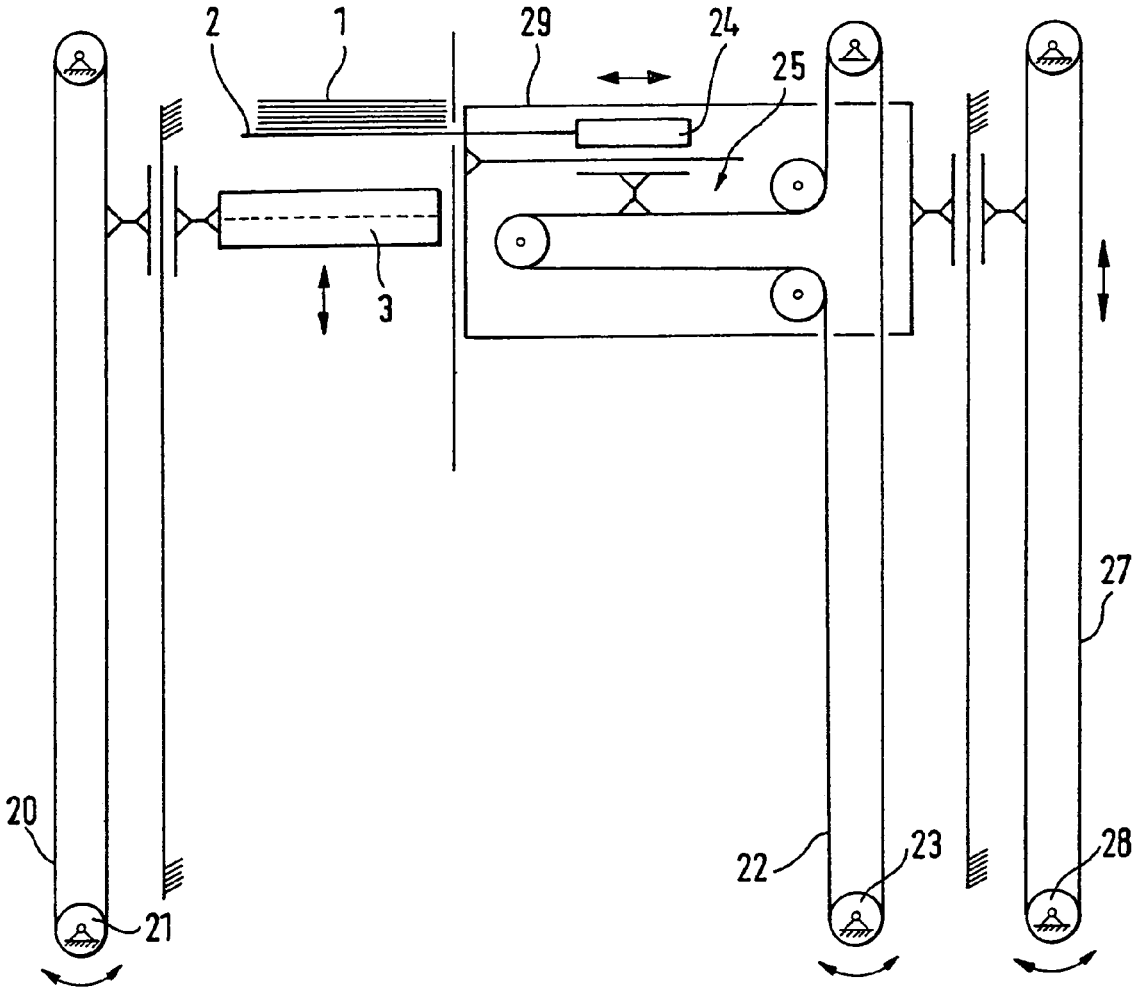
FIG. 9 shows a schematic view of the driving system of the feeding elements according to FIG. 2 or 8.

With reference to FIG. 9, an example of a driving system will now be described for the feeding elements 2, 3 as they can be used e.g. in the embodiments of FIGS. 2 and 8. For this purpose, it is preferred to provide a separate motor drive in each case for vertically driving the feeding elements 2, 3 and additionally a motor drive for horizontally moving the first feeding element, i.e. the rake 2. However, the motor for horizontally shifting the rake 2 should not be directly connected therewith and likewise moved vertically therewith, since output losses would occur due to the mass and the inertia of the motor to be moved. Therefore, all three motors will preferably be mounted stationarily. According to FIG. 9, three endless belts 20, 22, 27 will e.g. preferably be present in such a case, whereby three motors not shown can rotate the axles 21, 23, 28 of said endless belts actively in both directions in presettable fashion.

The first endless belt 20 is connected to the second feeding element 3 so that the second feeding element 3 can be shifted vertically by motor-controlled rotation of the axle 21. A further endless belt 27 is connected via a connecting plate 29 to the first feeding element 2 to be able to shift it vertically. To realize the horizontal motion of the first feeding element 2, the latter is furthermore connected to a horizontally displaceable slide 24 which is connected to the third endless belt 22 in an area 25. If only the endless belt 27 were rotated actively, this would lead to a simultaneously horizontal and vertical shift of the rake 2 due to the coupling of the endless belts 22, 27. By independent active control of the further endless belt 22, however, it can be obtained that the slide 24 and thus the rake 2 is not undesirably moved horizontally at the same time upon vertical shifting.

The invention claimed is:

1. An apparatus for continuously singling stacks of loose sheet material, comprising:

a singling unit for singling a stack of loose sheet material;

a feeding device for moving stacked loose sheet material to be singled along a feeding path from a deposit position to a position in which the uppermost sheet of the stacked loose sheet material can be grasped by the singling unit; and a stack inserting device for moving a stack of loose sheet material to be singled along an insertion direction into the deposit position, wherein the feeding device has a first feeding element being movable at least along two axes relative to the singling unit, a first axis of the axes being parallel to the feeding path and a second axis of the axes being orthogonal to both the feeding path and the insertion direction, the first feeding element being moveable along the second axis to be inserted into the feeding path, and a second feeding element being only uniaxially movable along the feeding path from a first position in which a stack of loose sheet material is insertable into the deposit position to a second position in which the uppermost sheet of the stack contacts the first feeding element.

2. The apparatus according to claim 1, wherein the first feeding element brings, by a uniaxial feeding motion, a stack of loose sheet material to be singled from the deposit position to the position in which the uppermost sheet of the stack can be grasped by the singling unit and, by being moved out of the feeding path, unites the stack to be singled with a stack to be fed located below the first feeding element.

3. The apparatus according to claim 1, wherein, the second feeding element brings, by a uniaxial motion on the feeding path, the stack to be fed from the deposit position to a position in which the uppermost sheet of the stack to be fed comes to lie below the first feeding element.

4. The apparatus according to claim 1, wherein the first feeding element assumes the position of the second feeding element by traversing a loop-shaped motion path and being inserted into the feeding path, and the second feeding element returns to the deposit position for receiving a stack to be fed on the feeding path.

5. The apparatus according to claim 1, wherein the second feeding element has depressions, and the first feeding element has a complementary formation for at least partly engaging the depressions.

6. The apparatus according to claim 1, wherein the first feeding element is moved into the feeding path below the stack of loose sheet material carried by the second feeding element.

7. The apparatus according to claim 1, wherein the second feeding element has a deposit surface which can be at least one of rotated, opened, horizontally shifted, and vertically shifted with respect to other components of the first feeding element.

8. The apparatus according to claim 1, wherein the second feeding element has a deposit surface with holes, and a plurality of opposing elements which can reach through the holes.

9. The apparatus according to claim 8, wherein the deposit surface with holes and the opposing elements can be shifted relative to each other for holding a stack of sheet material to be singled spaced from the deposit surface, and the opposing elements can engage the holes of the second feeding element to such an extent as to provide a substantially closed deposit surface for subsequent application of a loose stack of sheet material to be singled.

10. The apparatus according to claim 1, including one or more sensors configured to detect at least one of the presence of a stack fed by the second feeding element below the first feeding element, the last sheet of a stack to be singled, and a stack to be fed located in the deposit position.

11. The apparatus according to claim 1, wherein the first and second feeding elements are driven by stationary motors.

12. The apparatus according to claim 1, wherein feeding stacks of sheets to be singled to the feeding device may be carried out automatically and manually.

13. A method for continuously singling stacks of loose sheet material, comprising:

moving a stack of loose sheet material to be singled along an insertion direction into a deposit position by means of a stack inserting device; and moving stacked loose sheet material to be singled along a feeding path from the deposit position to a position from which an uppermost sheet of the stacked loose sheet material is grasped and singled by a singling unit by means of a feeding device having a first feeding element being movable at least along two axes relative to the singling unit, a first axis of the axes being parallel to the feeding path and a second axis of the axes being orthogonal to both the feeding path and the insertion direction, the first feeding element being moveable along the second axis to be inserted into the feeding path, and a second feeding element being only uniaxially movable along the feeding path from a first position in which a stack of loose sheet material is insertable into the deposit position to a second position in which the uppermost sheet of the stack contacts the first feeding element.

14. The method according to claim 13, comprising:

(a) feeding a stack of loose sheet material to be singled located on the first feeding element to the singling unit, by a feeding motion of the first feeding element on the feeding path from the deposit position to the position in which the uppermost sheet of the stack can be grasped by the singling unit, (b) singling the fed stack sheet by sheet by the singling unit, the stack being fed by the first feeding element such that the particular uppermost sheet of the stack can be grasped by the singling unit, (c) feeding a stack of loose sheet material to be fed located on the second feeding element to singling, by moving the second feeding element from the deposit position to a position in which the uppermost sheet of the stack to be fed is located below the first feeding element, and (d) uniting the stack to be singled and the fed stack by moving the first feeding element out of the feeding path.

15. The method according to claim 14, wherein after the step of uniting the stacks, the following further steps are carried out:

(e) taking over the united stack of loose sheet material by the first feeding element, whereby the first feeding element assumes the position of the second feeding element by traversing a loop-shaped motion path and being inserted into the feeding path, and (f) returning the second feeding element to the deposit position, (g) depositing a further stack of loose sheet material on the returned second feeding element and then feeding said further stack.

16. The method according to claim 15, wherein the traversing of the loop-shaped motion path of the first feeding element comprises the following movements:

(h) perpendicular motion leading away from the feeding path, (i) motion parallel to the feeding path in the direction of the deposit position to a position adjacent the second feeding element, and (k) perpendicular motion leading to the feeding path.

17. The method according to claim 14, wherein the first feeding element engages depressions of the second feeding element when being inserted into the feeding path.

18. The method according to claim 14, wherein the first feeding element is inserted into the feeding path below the stack of loose sheet material carried by the second feeding element.

19. The method according to claim 13, wherein a deposit surface of the second feeding element is at least one of rotated, opened, horizontally shifted, and vertically shifted with respect to other components of the first feeding element.

20. The method according to claim 13, wherein a plurality of opposing elements of the second feeding element reach through holes of a deposit surface of the second feeding element to hold a stack of sheet material to be singled.

21. The method according to claim 20, wherein the opposing elements engage the holes of the second feeding element to such an extent as to provide a substantially closed deposit surface for subsequent application of a loose stack of sheet material to be singled.

22. The method according to claim 13, wherein the presence of a fed stack below the stack to be singled is recognized automatically, and, as a result of the recognition, the uniting of the two stacks is initiated.

23. The method according to claim 13, wherein at least one of a stack of loose sheet material to be fed located in the deposit position and the last sheet to be singled in a stack to be singled is recognized automatically.

* * * * *